US006355896B1

(12) United States Patent
Cresgy

(10) Patent No.: US 6,355,896 B1
(45) Date of Patent: Mar. 12, 2002

(54) APPARATUS AND METHOD FOR STACKING OPTICAL DISCS

(75) Inventor: Joseph Dale Cresgy, Terre Haute, IN (US)

(73) Assignees: Sony Corporation, Tokyo (JP); Digital Audio Disc Corporation, Terre Haute, IN (US)

( * ) Notice: Subject to any disclaimer, the term of this patent is extended or adjusted under 35 U.S.C. 154(b) by 0 days.

(21) Appl. No.: 09/539,754

(22) Filed: Mar. 31, 2000

(51) Int. Cl.[7] ..... B07C 5/34

(52) U.S. Cl. ..... 209/583; 209/576; 209/577; 414/27; 414/908

(58) Field of Search ..... 209/503, 919, 209/927, 576, 577; 414/27, 908

(56) References Cited

U.S. PATENT DOCUMENTS 5,165,340 A * 11/1992 Karlyn et al.

5,913,652 A * 6/1999 Zejda

* cited by examiner

*Primary Examiner*—Donald P. Walsh
*Assistant Examiner*—Jonathan R Miller
(74) *Attorney, Agent, or Firm*—Wood, Herron & Evans, L.L.P.

(57) ABSTRACT

A sorting apparatus for sorting and receiving optical discs as a function of different quality control codes associated with respective optical discs including a base and a motor mounted to the base and having an output shaft. A turntable has a plurality of vertically oriented fixed spindles attached thereto, and the turntable is connected to, and rotates with, the output shaft of the motor. Each of the spindles has a diameter less than a diameter of a centerhole in the optical discs. A control is responsive to the quality control codes and operates the motor to rotate the turntable and move a spindle to a loading position for receiving an optical disc. The control selects the spindle to receive the optical disc so that only discs having a common quality control code are received by the spindle.

24 Claims, 5 Drawing Sheets

APPARATUS AND METHOD FOR STACKING OPTICAL DISCS

FIELD OF THE INVENTION

This invention relates generally to optical disc manufacturing and more particularly, to the handling of optical discs.

BACKGROUND OF THE INVENTION

The manufacturing process for many optical discs includes a process of printing a label on one side of the disc, inspecting that printing process for errors and thereafter, sorting the discs on the basis of the inspection process. In known processes, the printing of the label is performed on one machine, and the discs are then transferred to a second machine for inspection and sorting. The inspection process normally reads the bar code at the center of the disc that identifies the content of the disc, and that identification is compared with data from the printer identifying the label printed on the disc. If the bar code conforms with the printed label identifier, the disc is good; however, if there is a discrepancy between the bar code and the label identifier, the disc is rejected. The inspection process also performs a visual inspection of the label with a video camera to check the quality of the printed label. The disc is either accepted or rejected on the basis of the visual quality inspection of the label. The discs are then sorted and stacked on spindles on the basis of whether they are good, have failed the bar code inspection or have failed the visual inspection.

While that process is effective, the apparatus for carrying out the inspection and sorting process is relatively large and consumes significant manufacturing floor space. Further, some printers have the capability of simultaneously printing different labels on two discs at once; and therefore, two inspection and sorting processes must be carried out simultaneously by two inspection and sorting machines located next to the printer. Again, having two inspection and sorting machines next to a printing station requires even more manufacturing floor area and severely limits access to equipment around the printer as well as the printer itself.

Recent developments now permit the bar code and visual inspection processes to be conducted on the printer itself; and therefore, there is a need for a disc sorting and handling machine that can accept and sort discs from the printer on the basis of the inspection processes.

SUMMARY OF THE INVENTION

The present invention provides an optical disc sorting apparatus that is a substantial improvement over prior devices. The optical disc sorting apparatus of the present invention is fast, relatively small, relatively inexpensive to manufacture and reliable in operation. Thus, the disc sorting apparatus of the present invention consumes substantially less manufacturing floor space than prior devices and has the advantage of making manufacturing floor space more accessible and available for other uses.

According to the principles of the present invention and in accordance with the described embodiment, a sorting apparatus for sorting and receiving optical discs, as a function of different quality control codes associated with respective optical discs, includes a base and a motor mounted to the base and having an output shaft. A turntable has a plurality of vertically oriented fixed spindles attached thereto, and the turntable is connected to, and rotates with, the output shaft of the motor. Each of the spindles has a diameter less than a diameter of a centerhole in the optical discs. A control is responsive to the quality control codes and operates the motor to rotate the turntable and move a spindle to a loading position for receiving an optical disc. The control selects the spindle to receive the optical disc so that only discs having a common quality control code are received by the spindle. Thus, the invention has the advantage of quickly and easily sorting the optical discs as they are received by the sorting apparatus in accordance with the quality control codes assigned to the optical discs.

In another embodiment, the present invention provides a method of sorting optical discs onto spindles of a sorting apparatus as a function of different quality control codes associated with each of the respective optical discs. The method first identifies a quality control code for an optical disc to be transferred to the sorting apparatus. Next, a spindle associated with the state of the quality control code of the optical disc is moved to a loading position, and the optical disc is received on the spindle at the loading position. The above method of identifying, providing and receiving is iterated for other discs, whereby only discs having a common quality control code are received on a spindle thereby sorting and stacking the optical discs onto the spindles as a function of the different quality control codes.

These and other objects and advantages of the present invention will become more readily apparent during the following detailed description taken in conjunction with the drawings herein.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments given below, serve to explain the principles of the invention.

DETAILED DESCRIPTION OF THE DRAWINGS

Figure 1:
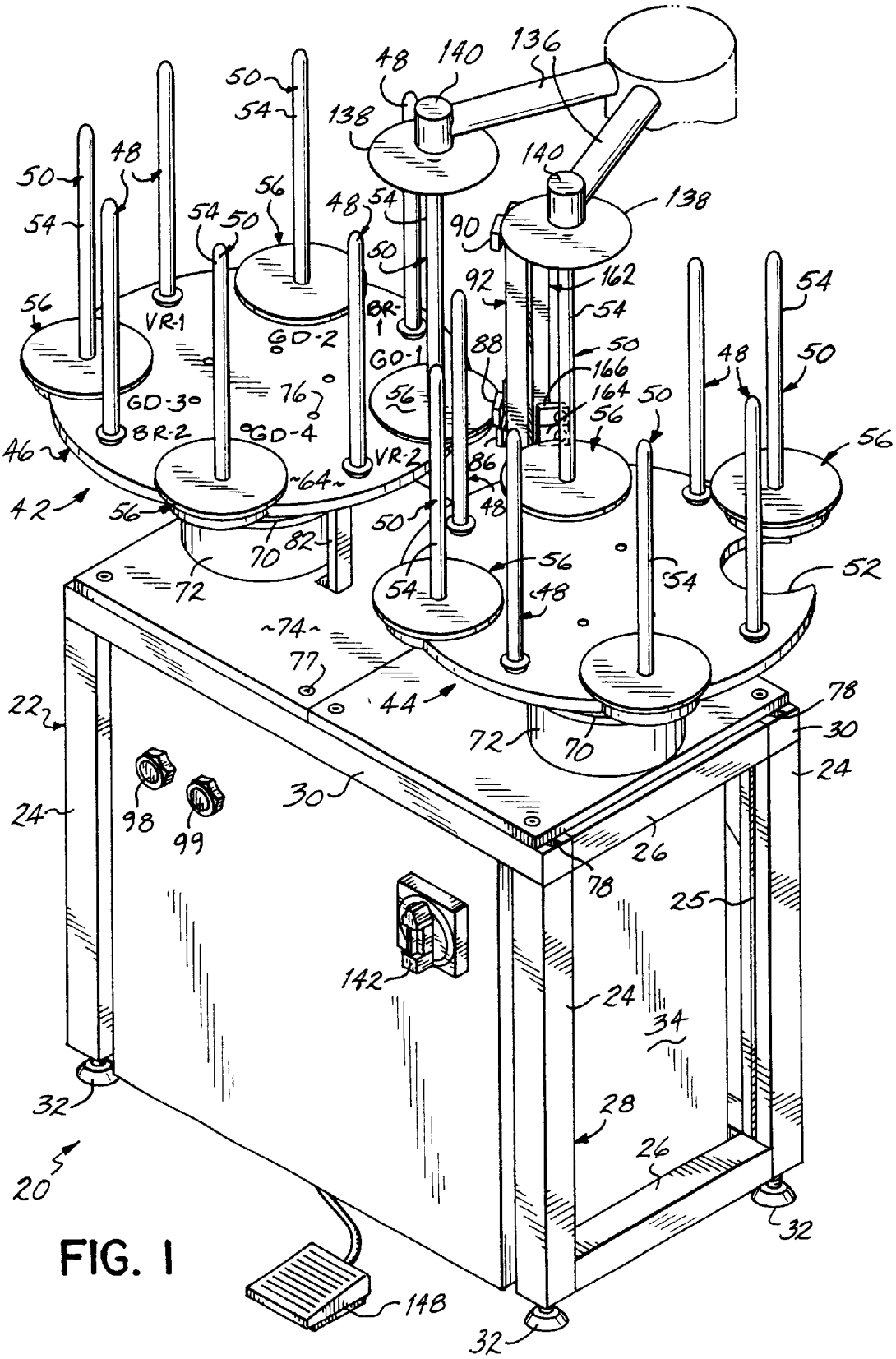
FIG. 1 is a perspective view of sorting apparatus in accordance with the principles of the present invention.

Referring to FIG. 1, a sorting apparatus 20 has a base or frame 22 comprised of vertical front and rear columns 24 connected at both ends to horizontal cross members 26 to form rectangular end frames 28. Horizontal front and rear rails 30 are connected at their ends to the end frames 28 to form the frame 22. The columns 24, cross members 26 and rails 30 can be made of any suitable material for such structural members, for example, extruded aluminum bar stock having a square cross-section with a generally T-shaped longitudinal slot in one or more of its sides. Such bar stock is available from Item Products, Inc. of Livonia, Mich. The cross members 26 are assembled to respective columns 24 or rails 30 by connecting a T-bolt at the end of a slot 25 in one side of a column 24 into a threaded center hole in an end of a cross member 26. A clearance hole is drilled through an opposite side of the column 24 to provide access for a tool that is used to turn the T-bolt. The ends of the rails 30 are connected to the upper ends of the columns 24 in a similar manner. Threaded center holes at the bottom of the columns 24 receive leveling feet 32. An electrical cabinet 34 is secured within the frame 22 by utilizing T-bolts in the slots of rails 30 and/or columns 24.

Figure 2:
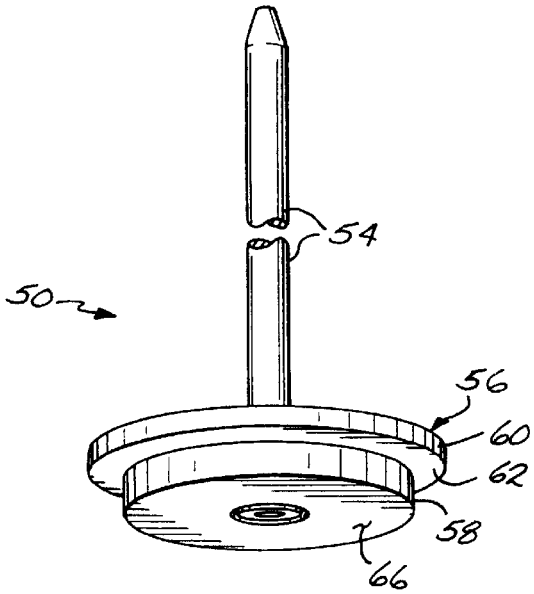
FIG. 2 is a perspective view of removable spindle used with the sorting apparatus of FIG. 1.

First and second sorting turntables 42, 44 are mounted on the frame 22. The turntables 42, 44 are identical in construction; and therefore, only turntable 42 will be described in detail. The sorting turntable 42 has a turntable plate 46 on which are mounted a plurality of spindles 48, 50. The spindles 48 are fixed into the plate 46 at their lower end and thus, are not generally removable without the use of tools. The spindles 50 are removably mounted into openings 52 around the circumference of the plate 46. Referring to FIG. 2, the removable spindles 50 have a spindle shaft 54 that is rigidly connected at its lower end to a spindle base 56. The spindle base has a lower circular portion 58 with a diameter slightly smaller than the diameter of the mounting hole 52 in the plate 46. The base 56 further has a circular flange 60 with a diameter greater than the diameter of the mounting hole 52 so that a bottom surface 62 of the flange 60 rests on the upper surface 64 of the plate 46 when the removable spindle 50 is mounted on the turntable plate 46. The mounting opening 52 is not closed so that a removable spindle 50 may be grasped and lifted by a bottom surface 66 of the base 56 when the spindle is inserted in, and removed from, the opening 52 in the turntable plate 46. The diameters of the fixed spindles 48 and the spindle shafts 54 are slightly smaller than the diameter of a center hole of an optical disc, thereby permitting the optical disc to slide down the shafts. The fixed spindles 48 and spindle shafts 54 may have any desired length, for example, a length sufficient to stack 150 optical discs.

Figure 3:
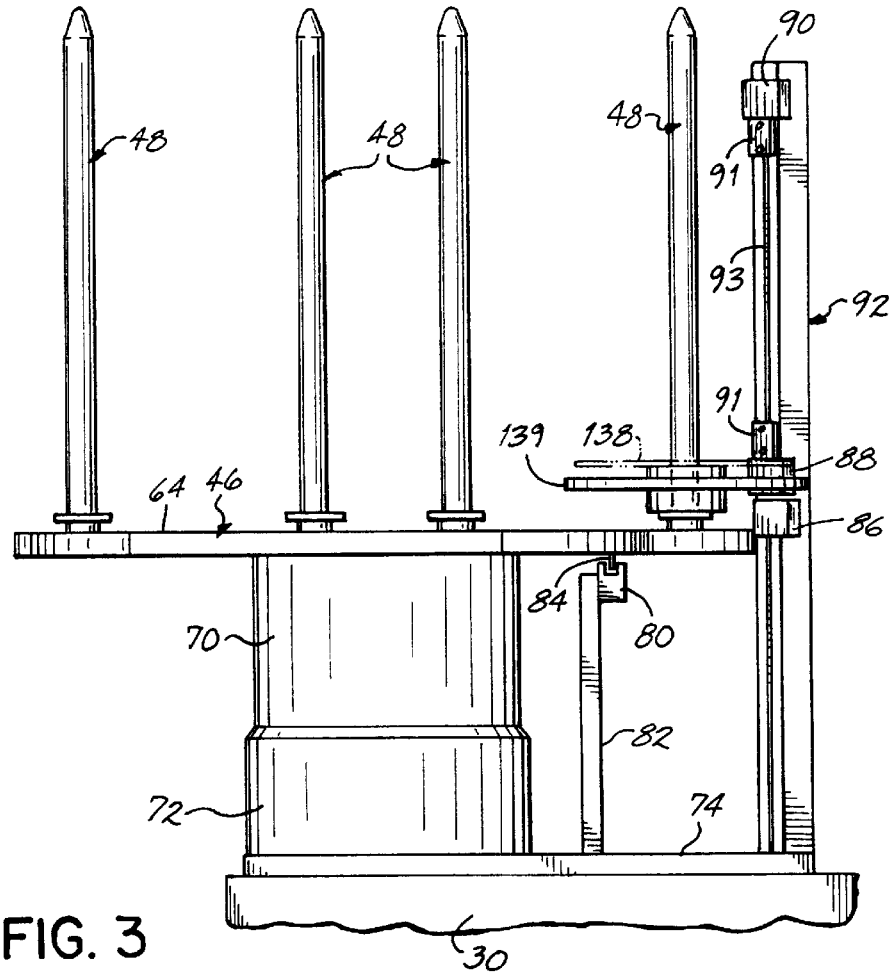
FIG. 3 is a fragmentary front elevation view of turntable plate and motor of the sorting apparatus of FIG. 1 without the removable spindles.

Referring to FIGS. 1 and 3, the turntable plate 46 is mounted to a rotatable output shaft 70 of a motor 72 by means of fasteners 76. The motor 72 may be any electric motor capable of rotating the turntable plate 46 at the desired velocity, for example, a DR Series direct drive brushless servo system motor commercially available from Parker Hannifin Corporation of Rohnert Park, Calif. The motor 72 is rigidly connected to a motor mounting plate 74 which, in turn, is mounted to the rails 30 of the frame 22 by means of T-bolts 77 extending from slots 78 in the rails 30. A home position sensor 80 is mounted on the upper end of a home sensor post 82, and the lower end of the sensor post 82 is connected to the motor mounting plate 74. The sensor 80 detects the proximity or presence of a pin 84 that is connected to the bottom of the turntable plate 46 and rotates therewith. The sensor 80 may be any sensor suitable for that application, for example, a Sunx photoelectric sensor commercially available from Ramco of West Des Moines, Iowa. Other sensors 86, 88, 90 are mounted on a sensor post 92 that is rigidly fixed at its lower end to the motor mounting plate 74 by means of fasteners, welding or other means. The sensor post 92 is located at a position immediately adjacent a spindle location that receives optical discs from the printer, and that spindle location is thus defined as a loading position or station. The sensor 86 is positioned on the post 92 with respect to the turntable plate 46 so as to be able to detect the presence of a flange 60 of a removable spindle 50 on the turntable plate 46. The sensor 88 is positioned on the post 92 such that it is able to detect an optical disc on the lowermost portion of any of the spindles 48, 50. The sensor 90 is positioned on the post 92 so as to detect an excess number of optical discs being stacked on any of the spindles 48, 50, resulting in overfilling the spindles. The sensors 88, 90 are mounted on blocks 91 to place the sensors 88, 90 closer to the optical discs on the spindles 48, 50. The sensor post 92 is made from any suitable material, for example, extruded aluminum with a slot 93. The sensor 88 and mounting blocks 91 are mounted with T-bolts extending from the slot 93 and therefore, may be easily mounted at any location along the sensor post 92. The sensors 86, 88, 90 may be any proximity sensor suitable for that purpose, for example, an BC Series Q08 sensor commercially available from Turck, Inc. of Minneapolis, Minn.

Figure 4:
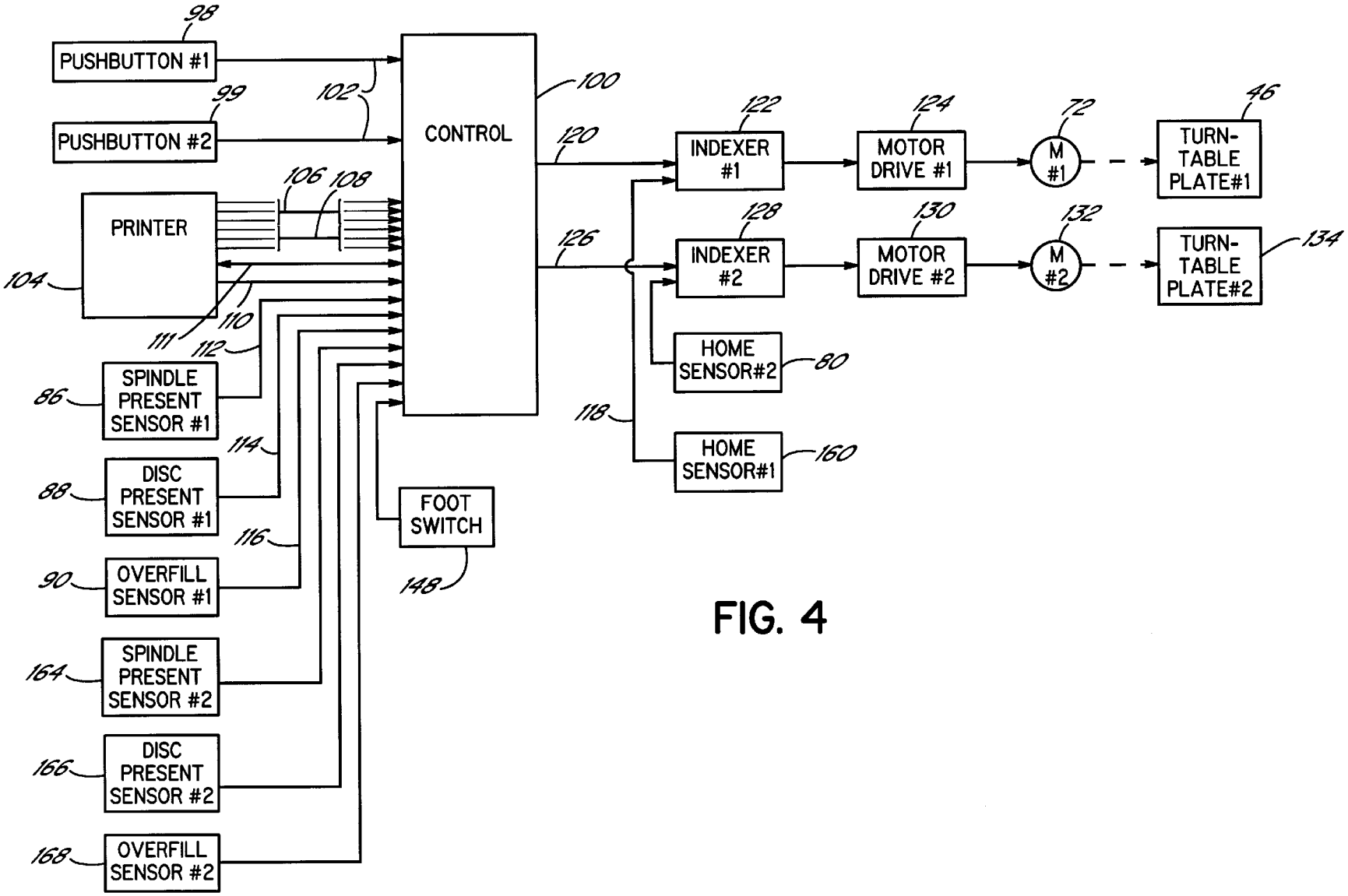
FIG. 4 is a schematic block diagram of a control system for operating the sorting apparatus of FIG. 1.

Referring to FIG. 4, a control 100 receives signals from pushbuttons 98, 99 on inputs 102. A printer 104 provides signals representing a good optical disc, a bar code reject and a vision reject for turntable 42 on inputs 106. The printer 104 also provides signals representing a good optical disc, a bar code reject and a vision reject for turntable 42 on inputs 108, and the printer 104 provides a disc ready signal on input 110. The control 100 also receives signals from the sensors 80, 86, 88, 90 on inputs 112, 114, 116, 118, respectively. The control 100, in response to the input signals, provides output signals on line 120 commanding a new angular position of the table plate 46. Those commands are processed by an indexer 122 which, in turn, provides output control signals to a motor drive 124. The motor drive then causes the motor 72 to rotate the table plate 46 of the first sorting turntable 42 to the commanded angular location. In a similar manner, the control 100 provides outputs on an output 126 to an indexer 128 that, in turn, causes a motor drive 130 to rotate a motor 132 and turntable plate 134 of the second sorting turntable 44 to a desired location. The control 100 may be any programmable controller having the logic capability to respond to the sensors and provide the desired position signals to the indexer 122. For example, a Sharp Manufacturing programmable controller, Series JW10 commercially available from Otec of Columbus, Ohio. The indexer 122 may be any device that is capable of receiving position command signals from the control 100 and provide the appropriate command signals to a motor drive 124, for example, a Model 500 indexer commercially available from Parker Hannifin Corporation of Rohnert Park, Calif.

In use, referring to FIG. 1, the sorting apparatus 20 is physically placed next to a printer (not shown in FIG. 1) on the manufacturing floor. A robotic element or transfer arm 136 is used in a known manner to transfer optical discs 138 between the sorting apparatus 20 and the printer. The transfer arm 136 has a disc pick up head 140 on each end of the arm. The disc pick up head 140 is any device capable of supporting an optical disc from its upper surface, for example, a vacuum chuck. The transfer arm 136 has the capability of moving vertically as well as indexing 180°; and therefore, the transfer arm 136 picks up discs from the printer with one end of the arm and releases discs to the sorting apparatus 20 with the other end of the arm. In a normal disc transfer cycle, the transfer arm 136 is moved vertically downward to permit a disc to be picked up from the printer. The arm 136 is then raised and rotated 180° so that the optical disc is located at the loading station with its center hole aligned immediately above, and concentrically with, one of the spindles 48, 50. Thereafter, the vacuum chuck releases the optical disc and it drops onto the spindle.

Prior to beginning a disc sorting operation, each of the sorting turntables 42, 44 must be positioned and aligned with respect to the part transfer arm 136. Using sorting turntable 42 as an example, the sorting apparatus 22 is initially positioned with respect to the part transfer arm 136 so that the center hole within the optical disc is approximately coincident with the spindles 48, 50 as determined by visual inspection. For a precise alignment, the bolts 77 are loosened so that the mounting plate 74 and turntable plate 46 can be moved longitudinally with respect to the frame 22. In addition, the motor 72 may be provided with incremental commands from the control 100 via the indexer 122 to rotate the turntable plate 46 through a commanded angular displacement with respect to the home position as detected by the sensor 80. Those two adjustments facilitate an accurate and coincident alignment of the center hole of the optical disc with the spindle 48, 50 of the sorting turntable 42. The sorting turntable 44 is aligned with the transfer arm 136 by a similar process.

Figure 5A:
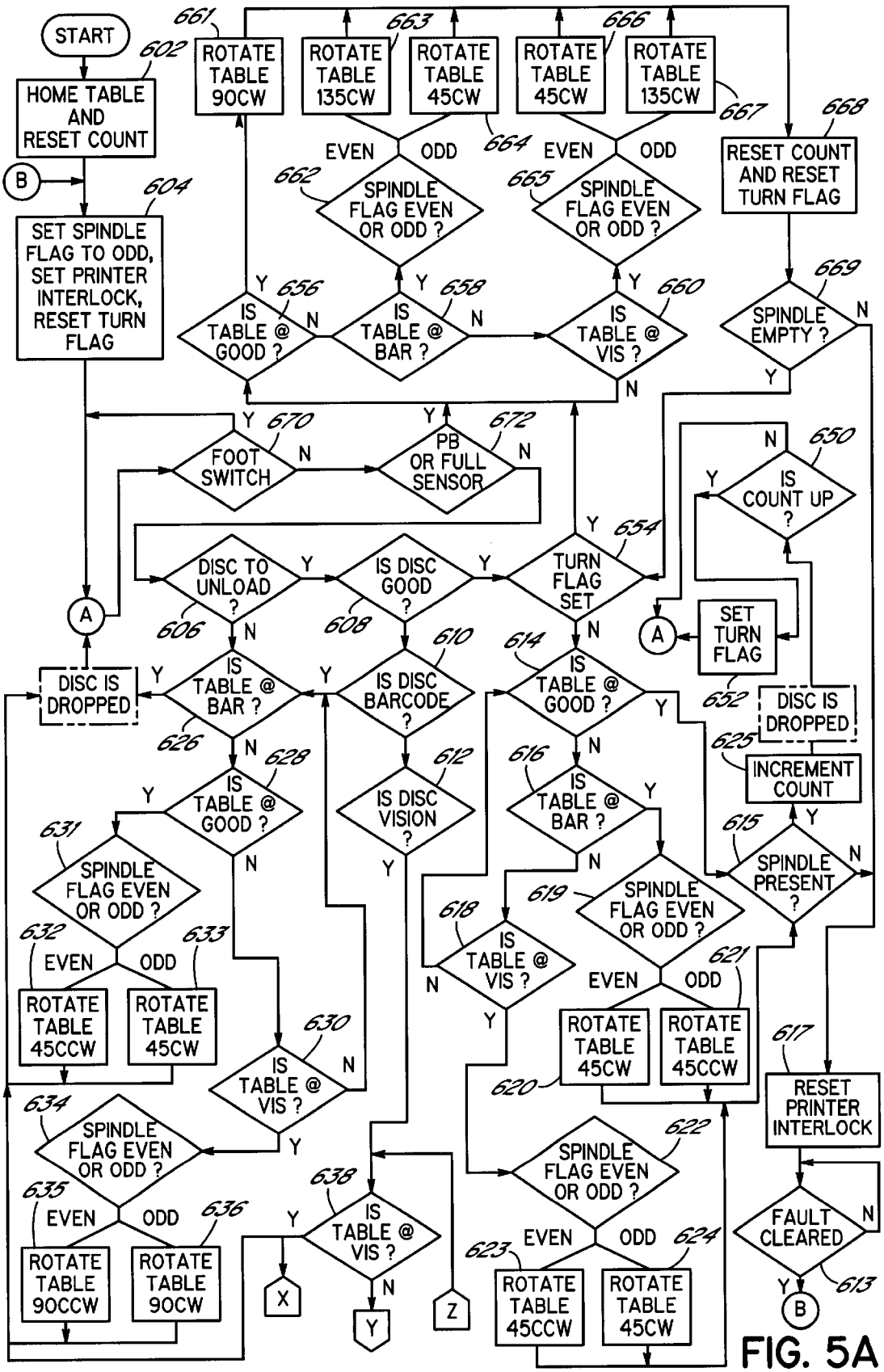
FIGS. 5A and 5B are a flowchart illustrating the process executed by the control of FIG. 4 in controlling the sorting apparatus of FIG. 1 in a cycle of operation.
Figure 5B:
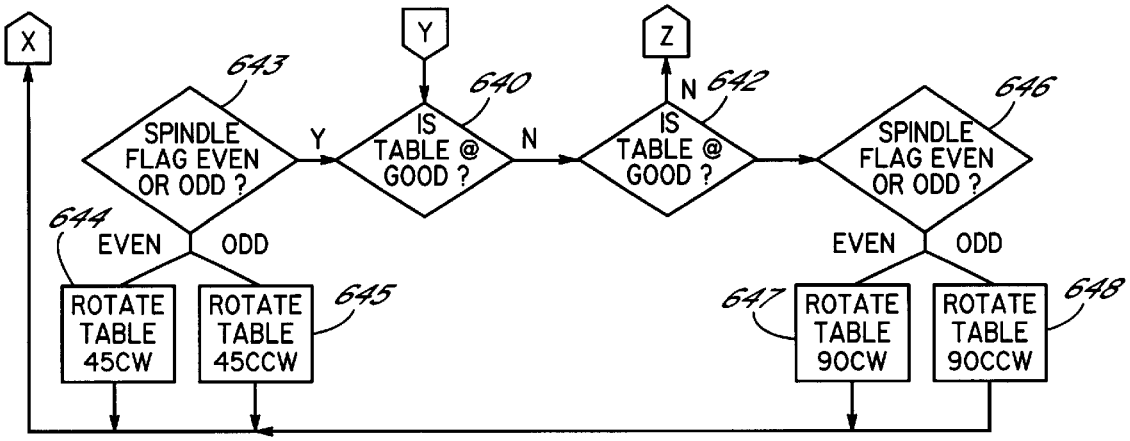

Thereafter, the sorting turntables 42, 44 perform a sorting operation in accordance with the process illustrated in FIGS. 5A and 5B. Again, the sorting operation is described with respect to the operation of the sorting turntable 42. Power is applied to the sorting apparatus control system components illustrated in FIG. 4 by operating a disconnect switch 142 (FIG. 1). The control 100, first at 602, operates the motor 72 to move the turntable plate 46 to the home position as determined by the home position sensor 80 detecting a home position pin 84 (FIG. 3). That home position is then offset by any angular displacements which were used to align a spindle at the loading station with the optical disc 138 on the end of the part transfer arm 136. Next, at 604, the spindle flag is set, and the turn flag is reset.

Each spindle location has an identifier dependent on the disc being loaded on the spindle. For example, referring to FIG. 1, the good discs are loaded on the removable spindles which are identified as GD-1, GD-2, GD-3 and GD-4. The fixed spindles 48 receive defective discs, and the defective discs are sorted on the basis of whether they are a bar code reject or a vision reject. Further, to minimize cycle time, each good disc spindle has a bar code reject spindle on one side and a vision reject spindle on the other. Thus, there are two bar code reject spindles BR-1, BR-2 and two vision reject spindles VR-1, VR-2. Each spindle is now identified by an odd or even number. Further, if an odd numbered good disc spindle 50 is at the loading position, the turntable plate 46 must be rotated 45° clockwise to place a bar code reject spindle at the loading position or rotated 45° counterclockwise to place a vision reject spindle at the loading position. In contrast, if an even numbered good disc spindle is at the loading position, the plate must be rotated counterclockwise to place a bar code reject spindle at the loading position or rotated 45° clockwise to place a vision reject spindle at the loading position.

As previously mentioned, to pick up an optical disc from the printer, the part transfer arm 136 must be lowered and then raised. In order to avoid any potential for interference with the opposite end of the part transfer arm 136 over the loading position, the turntable 42 does not perform a sorting motion until the part transfer arm 136 has picked up a disc from the printer station and is in its uppermost position. At that time, the printer provides a "disc-to-unload" signal on input 110 of the control 100 (FIG. 4). Simultaneously, the printer provides quality control signals for the disc on input 106 indicating the quality of the respective discs. For example, for each of the discs, the printer will change the state of a first quality control signal if the disc is good, change the state of a second quality control code signal if the disc has been rejected by the bar code quality test or change the state of a third quality control code signal if the disc has failed the vision test. The control 100 then, at 608, 610, 612, detects which quality control code signal is associated with the disc to be transferred to the sorting apparatus 20.

If, at 608, the disc is determined from the quality control code to be a good one, the control 100 then, at 614, 616, 618, determines which spindle is currently at the loading station under the part transfer arm 136. If a good disc spindle is at the loading station, the turntable is not rotated. However, if one of the reject disc spindles 48 is at the loading station, the control process, at 619–624, provides commands to rotate the turntable to move a good disc spindle to the loading station. After the control moves a good disc spindle to the loading position, the control process, at 615, detects the state of the spindle sensor 86, and if the spindle sensor 86 does not sense the presence of a spindle, the control process, at 617, resets or switches a printer interlock line output 111 (FIG. 4) to an off-state. The printer 104 detects the off-state of the printer interlock output and terminates its operation. The operator is now required to clear the fault condition by, for example, placing an empty spindle at the load station. Upon the switch 86 detecting the presence of the spindle, it changes its state; and, at 613, the control process detects that the fault is cleared. The control process returns to step 604 which sets or switches the printer interlock to an onstate. The sorting apparatus 20 is now ready to resume operation upon the operator reinitiating operation of the printer 104.

A disc is then dropped onto the spindle; and at 625, the control 100 increments a counter that keeps track of the number of good discs on the good disc spindle being loaded. It should be noted that the control 100 does not command the release of the disc from the transfer arm 136. The operation of the transfer arm 136 is operated by another controller, for example, a controller operating the printer or a system controller. The sorting apparatus 20 is designed so that after it receives a "disc-to-unload" signal from the printer controller, it is able to position the correct spindle at the loading station in less time that is required to rotate the transfer arm 136. Therefore, by the time the part transfer arm 136 is rotated 180° and the chuck 140 is operated to release the disc 138, the control 100 has already positioned the correct spindle at the loading station; and upon being released by the chuck 140, the disc 138 falls onto the correct spindle 48, 50. Referring to FIG. 3, the disc 138 comes to rest on a spindle spacer 139. The spindle spacer 139 is used to lift and remove a stack of discs 138 from the spindle 48, 50 without touching any of the discs 138.

If, at 610, the disc is determined from the quality control code to have a bar code fault, the control 100 then, at 626, 628, 630, determines which spindle is currently at the loading station under the part transfer arm 136. If a bar code reject spindle is at the loading station, the turntable is not rotated. However, if a good disc spindle or a vision reject spindle is at the loading station, the control process, at 631–636, provides commands to rotate the turntable to move a bar code reject to the loading station.

In a similar manner, if at 612, the disc is determined from the quality control code to have a vision fault, the control 100 then, at 638, 640, 642, determines which spindle is currently at the loading station under the part transfer arm 136. If a vision reject spindle is at the loading station, the turntable is not rotated. However, if a good disc spindle or a bar code reject spindle is at the loading station, the control process, at 643–648, provides commands to rotate the turntable to move a bar code reject to the loading station.

As the process of FIGS. 5A and 5B is iterated with each disc transfer, the good disc counter in the control 100 is appropriately incremented until, at 650, a desired number of discs have been loaded onto the currently active good disc spindle, for example, 150 discs. A turn flag is then set at 652; and the next time through the process, the program, at 654, detects that the turn flag is set. Thereafter, at 656, 658, 660, the process determines whether the spindle currently at the loading station is a good disc spindle, a bar code reject spindle or a vision reject spindle. The control process then, at 661–667, provides an appropriate command signal from the control 100 to move a similarly identified spindle to the loading position. Then, at 668, the good disc counter is reset and the turn flag is reset.

Thereafter, the control process, at 669, detects the state of sensor 88, and if sensor 88 determines that the spindle that was just rotated into the loading station contains an optical disc, the control process, at 617, resets or switches a printer interlock line output 111 (FIG. 4) to an off-state. The printer 104 detects the off-state of the printer interlock output and terminates its operation. The operator is now required to clear the fault condition by, for example, removing the disc from the spindle in the loading station. Upon the switch 88 detecting an absence of a disc and changing state, the control process, at 613, detects that the fault is cleared, and the process returns to step 604 which sets or switches the printer interlock to an on-state. The sorting apparatus 20 is now ready to resume operation upon the operator reinitiating operation of the printer 104.

After a good disc spindle is fully loaded, it will be rotated to a location other than the loading position, and the operator can simply lift the spindle full of discs from the turntable plate and insert a new empty spindle. Further, at any time, the operator may replace the spindle currently at the loading position with a new spindle. Further, the spindle replacing the old spindle will have the same identity as the old spindle. To achieve that spindle replacement with respect to sorting turntable 42, the operator simply depresses pushbutton 98 (FIG. 1). The control process of FIG. 5A detects that pushbutton actuation, at 672, and immediately, at 656–668, executes a spindle turn routine as just described. Similarly, the overfill sensor 90 may detect that an excessive number of optical discs is being stacked on a spindle. If the control 100 detects a signal from the overflow sensor 90, the control process, at 672, immediately executes the turn routine at 656–668.

Referring to FIG. 1, if at any time the operator is working around the sorting apparatus 20 without removing power via the disconnect switch 142, the operator may depress the foot switch 148 which is electrically connected to the control 100 of FIG. 4. Referring to FIG. 5A, the foot switch 148, at 670, inhibits the operation of the control process of FIGS. 5A and 5B for as long as the foot switch is actuated or depressed. When the operator releases the foot switch 148, the control process of FIGS. 5A and SB operates as previously described.

It should be noted that, at 606, if a "disc-to-unload" signal is not received from the printer, the control process then operates, at 626–636, to move a bar code reject spindle to the loading station. This is done to accommodate the situation in which the "disc-to-unload" disc is not received, but in fact, a disc is somehow present at the end of the robot arm. In that event, when the robot arm rotates 180° and the disc is released, the disc will be loaded onto the bar code reject spindle.

As will be appreciated, a single turntable 42 or 44 and control 100 may be used to implement the process of FIGS. 5A and 5B. Alternatively, the sorting apparatus 20 may utilize both of the sorting turntables 42, 44, depending on the capabilities of the printer with which the sorting apparatus 20 is being interfaced. The turntable 44 has substantially the same construction as just described with respect to turntable 42. For example, turntable 44 has fixed and removable spindles 48, 50, respectively, and is rotatably mounted adjacent a home sensor 160 and a sensor post 162 that has a spindle present sensor 164, disc present sensor 166 and overfill sensor 168 mounted thereon. The sensors 160, 164, 166 and 168 function identically to the respective sensors 80, 86, 88 and 90 previously described, and therefore, the control 100 provides a cycle of operation for turntable 44 identical to the cycle of operation described with respect to FIGS. 5A and 5B.

While the invention has been illustrated by the description of one embodiment, and while the embodiment has been described in considerable detail, there is no intention to restrict nor in any way limit the scope of the appended claims to such detail. Additional advantages and modifications will readily appear to those who are skilled in the art. Therefore, the invention in its broadest aspects is not limited to the specific details shown and described. Consequently, departures may be made from the details described herein without departing from the spirit and scope of the claims which follow.

What is claimed is:

1. A sorting apparatus for sorting and receiving optical discs as a function of at least two different quality control codes associated with respective optical discs comprising:

a base;

a motor mounted to the base and having an output shaft;

a turntable connected to the output shaft of the motor having a plurality of vertically oriented fixed spindles thereon, each of the spindles having a diameter less than a diameter of a centerhole in the optical discs and at least two of the spindles being assigned to receive optical discs having the two different quality control codes; and a control electrically connected to the motor and responsive to the quality control codes for operating the motor to rotate the turntable and move, to a loading position, a spindle assigned one of the two quality control codes identical to a respective one of the quality control codes associated with an optical disc being transferred to the sorting apparatus.

2. The sorting apparatus of claim 1 further comprising a first sensor for sensing a known position of the spindles.

3. The sorting apparatus of claim 1 wherein there are two quality control codes and at least two spindles are mounted on the turntable, each of the spindles being associated with one of the quality control codes.

4. The sorting apparatus of claim 1 wherein there are three quality control codes and at least three spindles are mounted on the turntable, each of the spindles being associated with one of the quality control codes.

5. The sorting apparatus of claim 1 wherein there are three quality control codes and eight spindles are mounted on the turntable, each of the spindles being associated with one of the quality control codes.

6. The sorting apparatus of claim 5 wherein the eight spindles are substantially equally spaced about a periphery of the turntable.

7. The sorting apparatus of claim 6 wherein four of the spindles are removably mounted on the turntable and four of the spindles are fixed on the turntable.

8. The sorting apparatus of claim 7 wherein the turntable has a plurality of openings for receiving the removably mounted spindles and the openings intersect the periphery of the turntable.

9. The sorting apparatus of claim 7 further comprising a sensor for detecting a presence of a removably mounted spindle in one of the openings.

10. The sorting apparatus of claim 7 further comprising a sensor for detecting a presence of an optical disc on a spindle.

11. The sorting apparatus of claim 1 further comprising a sensor for detecting a known position of the turntable with respect to the base.

12. The sorting apparatus of claim 1 further comprising a sensor for detecting an excessive number of optical discs on a spindle.

13. A method of sorting optical discs onto spindles of a sorting apparatus as a function of at least two different quality control codes associated with each of the respective optical discs comprising:

identifying a first quality control code associated with an optical disc being transferred to the sorting apparatus, the first quality control code being one of the two quality control codes;

providing at least two spindles on a turntable rotatable by a motor wherein each of the two spindles is exclusively associated with one of the two quality control codes;

moving one of the two spindles associated with the first quality control code to a loading position;

receiving on the one of the two spindles an optical disc being transferred to the sorting apparatus and associated with the first quality control code; and iterating the above steps of identifying, providing and receiving for other discs whereby only discs having a common quality control code are received on a spindle, thereby sorting and stacking the optical discs onto the spindles as a function of the different quality control codes.

14. The method of claim 13 further comprising:

detecting an absence of a spindle at the loading position, and inhibiting the step of receiving the optical disc.

15. The method of claim 14 further comprising initiating the step of receiving the optical disc in response to detecting a presence of a spindle at the loading position.

16. The method of claim 13 further comprising:

detecting a presence of a disc prior to receiving a first optical disc on the spindle; and inhibiting the step of receiving the optical disc.

17. The method of claim 16 further comprising initiating the step of receiving the optical disc in response to detecting an absence of a disc on a spindle prior to receiving a first optical disc on the spindle.

18. The method of claim 13 further comprising:

prior to identifying a quality control code, moving the spindle with respect to the sorting apparatus; and stopping motion of the spindle at a known location.

19. The method of claim 13 wherein the spindle represents a good disc spindle and the method further comprises counting a number of discs received by the good disc spindle.

20. The method of claim 13 further comprises:

providing a first good disc spindle at the loading position;

receiving optical discs on the good disc spindle;

counting the optical discs being received on the good disc spindle;

providing a second good disc spindle at the loading position in response to counting a desired number of optical discs received on the first good disc spindle.

21. The method of claim 20 further comprising:

detecting, with a sensor, a number of optical discs on the good disc spindle exceeding the desired number; and providing another good disc spindle at the loading position in response to the sensor detecting the number of optical discs on the good disc spindle exceeding the desired number.

22. The method of claim 13 further comprising:

providing a switch for moving another spindle to the loading position for receiving optical discs having a common quality control code as a current spindle at the loading position; and moving the other spindle to the loading position in response to an actuation of the switch.

23. The method of claim 13 further comprising:

providing a switch for inhibiting operation of the sorting apparatus;

inhibiting operation of the sorting apparatus in response to an activation of the switch; and resuming operation of the sorting apparatus in response to a deactivation of the switch.

24. A sorting apparatus for sorting and receiving optical discs as a function of at least two different quality control codes associated with respective optical discs comprising:

a base;

a motor mounted to the base and having an output shaft;

a plurality of vertically oriented fixed spindles being mounted to move with rotation of the output shaft of the motor, each of the spindles having a diameter less than a diameter of a centerhole in the optical discs and at least two of the spindles being assigned to receive optical discs having the two different quality control codes; and a control electrically connected to the motor and responsive to the quality control codes for operating the motor to move a spindle to a loading position for receiving an optical disc, the control selecting a spindle having a quality control code corresponding to a quality control code associated with an optical disc being received, so that each of the spindles assigned the two different quality control codes receive only optical discs associated with one of the two different quality control codes.

* * * * *